US007156112B2

(12) United States Patent
Ullrey et al.

(10) Patent No.: US 7,156,112 B2
(45) Date of Patent: Jan. 2, 2007

(54) METHOD AND APPARATUS FOR CLEANING PAINT SUPPLY SYSTEMS

(75) Inventors: Jeffrey C. Ullrey, Rockford, MI (US); Michael L. Piper, Marne, MI (US); Richard J. Tice, Belding, MI (US)

(73) Assignee: Filter and Coating Technology, Inc., Belmont, MI (US)

( * ) Notice: Subject to any disclaimer, the term of this patent is extended or adjusted under 35 U.S.C. 154(b) by 325 days.

(21) Appl. No.: 10/202,259

(22) Filed: Jul. 24, 2002

(65) Prior Publication Data

US 2004/0016448 A1 Jan. 29, 2004

(51) Int. Cl.
*B08B 7/04* (2006.01)

(52) U.S. Cl. ..... 134/22.18; 134/102.2; 134/169 C

(58) Field of Classification Search ..... 134/22.12, 134/22.14, 22.18, 22.19, 102.2, 168 C, 169 C, 134/18, 38

See application file for complete search history.

(56) References Cited

U.S. PATENT DOCUMENTS 4,785,836 A * 11/1988 Yamamoto ..... 134/56 R
5,174,317 A * 12/1992 Robb et al. ..... 134/166 C
5,699,817 A * 12/1997 Bankert et al. ..... 134/102.2
5,704,381 A * 1/1998 Millan et al. ..... 134/102.2
6,003,530 A * 12/1999 Giuseppe ..... 134/102.1
6,569,258 B1 * 5/2003 Clifford et al. ..... 134/36

* cited by examiner

*Primary Examiner*—Alexander Markoff
(74) *Attorney, Agent, or Firm*—Warner Norcross & Judd LLP

(57) ABSTRACT

A solvent flush cleaning system for a paint supply system. The cleaning system includes an air injection system that injects air directly into the pumping chambers of the solvent pump to entrain air within the solvent. The cleaning system preferably includes a dedicated double diaphragm pump that circulates the solvent. The air injection system preferably includes a pair of injection valves that cooperate to selectively supply pressurized air to each pumping chamber. The air injection system further includes an actuation assembly that times the injection valves so that pressurized air is supplied to each pumping chamber as that chamber expands. The actuation assembly includes actuation valves that are operated by pressure within the air chambers of the pump. When pressure builds in one air chamber, it opens the corresponding actuation valve, which in turn actuates the injection valve causing pressurized air to be supplied to the opposite pumping chamber.

17 Claims, 8 Drawing Sheets

METHOD AND APPARATUS FOR CLEANING PAINT SUPPLY SYSTEMS

BACKGROUND OF THE INVENTION

The present invention relates to paint supply systems, and more particularly to a apparatus and method for cleaning paint supply systems.

Paint supply systems are used in a wide variety of industries to facilitate the application of paint and other coatings. Conventional paint supply systems supply paint and other coatings from a central location to one or more painting or coating stations. A conventional paint supply system 200 is illustrated schematically in FIG. 1. As shown, the paint supply system 200 generally includes a module 202 that is connected to a paint circulation network 204. The module 202 typically includes a pump 206, a surge eliminator 208, a filter 210, a back pressure regulator 212 and a paint supply reservoir 214. The paint circulating network 204 preferably includes a network of paint heads or drops 216*a–c* that are connected to the module 202 by a plurality of paint lines 216.

It is often necessary to clean the paint supply system, for example, when switching between different color paints or different types of coatings. In some applications, it is not uncommon to clean the system 18–20 times in a single day. Paint supply systems are often cleaned by circulating a solvent flush through the system. This function is typically performed by replacing the paint reservoir with a solvent reservoir so that the pump 206 pumps solvent, rather than paint, through the system 200. The solvent circulates through the module 202 and paint supply lines 216 to flush paint from the system.

In some applications, a plastic plug or "pig" is used to facilitate cleaning. The pig is passed through the paint lines prior to the introduction of solvent to physically force old paint out of the lines. A conventional pig has a fixed diameter that is specifically matched to the interior diameter of the paint supply lines to be cleaned. Because of the interior configuration of the pump and other module components, the pig is typically incapable of being passed through any portion of the module. Accordingly, the pig is generally passed only through the paint lines. Even with the use of a plug, conventional cleaning systems provide only limited effectiveness.

To provide improved cleaning, one conventional system introduces air directly into the paint supply lines through the operation of an electronic control system 224 (shown in phantom lines in FIG. 1). In this system, air is injected directly into the line downstream from the pump. The air combines with the solvent and is carried through the supply lines. The air/solvent combination typically provides better cleaning performance than straight solvent flushes. Unfortunately, the electronic control system of this system is relatively expensive, placing a practical limitation on its use.

SUMMARY OF THE INVENTION

The aforementioned problems are overcome by the present invention wherein a solvent-based cleaning system is provided with a mechanical air injection system that selectively inject air into the pumping chambers of the pump to entrain air within the solvent. The system preferably includes a pair of air injection valves that selectively route pressurized air to the pumping chambers. The air injection valves are preferably timed to alternately supply pressurized air to each pumping chamber as each chamber is undergoing expansion.

In a preferred embodiment, the cleaning system includes a double diaphragm pump having a pair of air chambers and a pair of pumping chambers. The cleaning system further includes a pair of actuation valves, one operatively connected to each air chamber. The actuation valves selectively supply line pressure to the air injection valves. When pressure with an air chamber builds, it causes the corresponding actuation valve to open, thereby supplying pressurized air to flow to the corresponding air injection valve. The pressurized air opens the air injection valve causing pressurized air to be injected into the appropriate pumping chamber.

In an alternative embodiment, the air injection valves are connected directly to the pumping chambers. In this embodiment, the pressure in the pumping chambers directly actuates the corresponding air injection valves.

In another alternative embodiment, the actuation valves are connected to the exhaust for the two air chambers. When air is exhausted from an air chamber, the pressure within the exhaust is utilized to open the corresponding actuation valve. In some applications, the air injection valves can be connected directly to the exhaust, thereby eliminating the need for the actuation valves.

In yet another alternative embodiment, the air injection system can be integrated into the paint supply pump rather than a separate cleaning pump. This permits the system to be flushed without the need for pump switch-out. It also permits the paint supply pump to itself be flushed by the cleaning system.

The present invention provides a simple and effective cleaning system for a paint supply system. The injection of pressurized air into the pumping chamber utilizes the mechanical action of the pump to provide improved entrainment of air within the solvent. This dramatically improves the effectiveness of the system. The mechanical system of the present invention is also substantially less expensive than pre-existing electronically controlled air injection systems. This permits use of the cleaning system in a variety of applications where pre-existing systems proved cost prohibitive. In one embodiment, the cleaning system includes a separate, dedicated pump. In this embodiment, the cleaning system is easily installed and removed from the paint supply lines, thereby reducing the time and expense of cleaning. In another embodiment, the cleaning system is integrated into the paint supply pump. This further saves time and labor costs by eliminating the need to install and remove the system at each cleaning. Additionally, the use of separate actuation and air injection valves provides the system with a high degree of isolation—preventing high pressure surges in the air chamber from damaging the injection valves and preventing high pressure solvent from overcoming the actuation valves.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
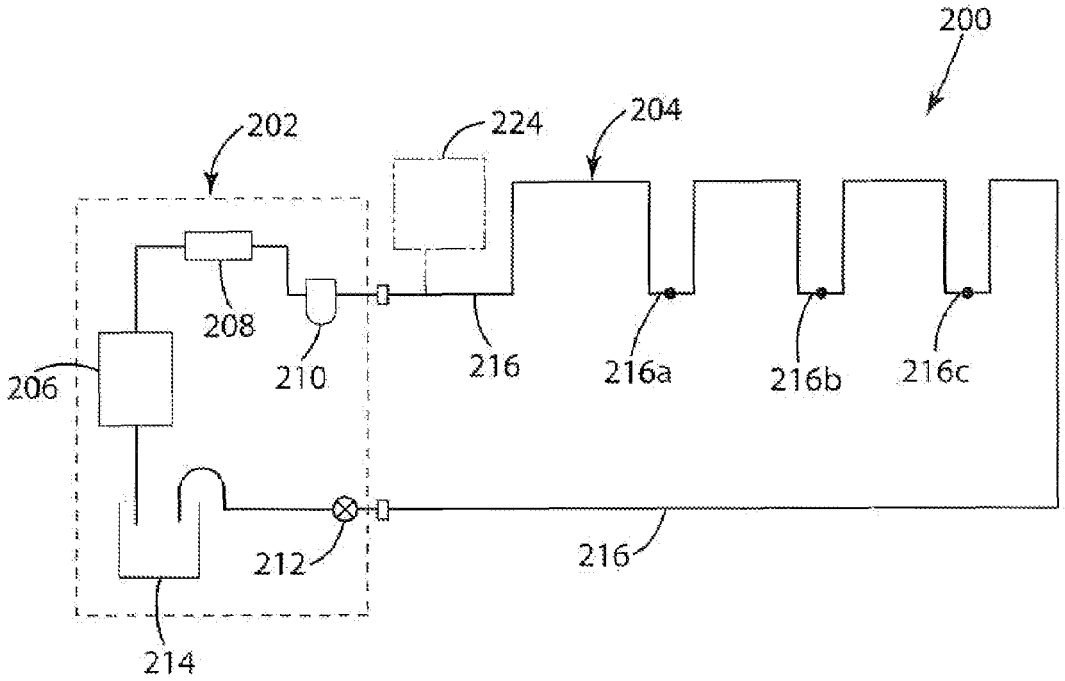
Fig. 1 (Prior Art)
FIG. 1 is a schematic diagram of a prior art paint supply system.
Figure 2:
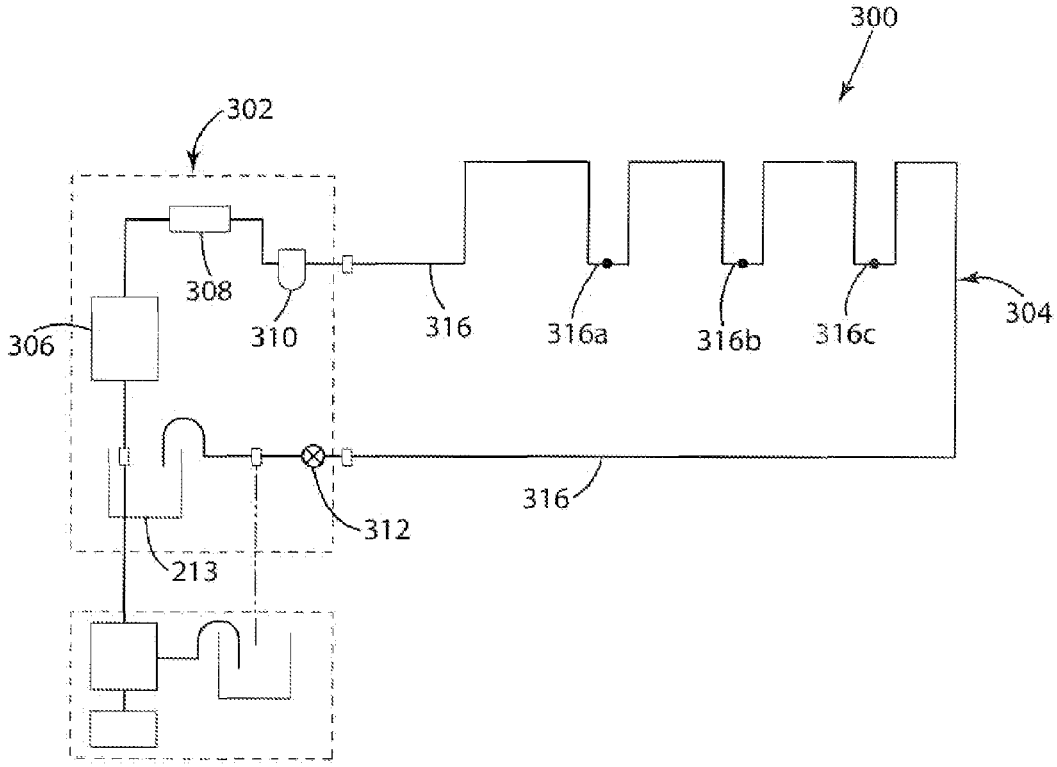
FIG. 2 is a schematic diagram of a paint supply system incorporating a cleaning system in accordance with a preferred embodiment of the invention.

A cleaning system according to a preferred embodiment of the present invention in shown in FIG. 2 and generally designated 10. The cleaning system generally includes a double diaphragm pump 12 for circulating solvent through a paint lines 14 and an air injection system 16 for delivering pressurized air to the pumping chambers 18*a–b* of the solvent pump 12. In operation, a pocket of air is injected into each pumping chamber 18*a–b* as the chamber 18*a–b* goes through the loading stage (i.e. is expanding to draw solvent into the chamber). This air is entrained with the solvent and provides improved cleaning of the paint line. The present invention is described in connection with a conventional double diaphragm pump that is a dedicated part of the cleaning system. The cleaning system of the present invention is well suited for use with other types of pumps and, in some applications, may be incorporated directly into the paint supply pump.

As noted above, the cleaning system 10 includes a solvent pump 12 that circulates a solvent through the paint line 14. In this embodiment, the solvent pump 12 is a generally conventional double-action diaphragm pump 12 having a housing 20 defining an inlet 26, an outlet 28 and a pair of chambers 22*a–b*. The pump 12 includes a diaphragm rod 30 having a pair of diaphragms 32*a–b* mounted to opposites ends of a rod 34. The diaphragm rod 30 is movably mounted within the chambers 22*a–b*. Each diaphragm 32*a–b* divides the corresponding chamber 22*a–b* into air chambers 24*a–b* and a pumping chambers 18*a–b*. The solvent pump 12 includes an air control assembly 40 that, during operation, causes the diaphragm rod 30 to reciprocate within the housing 20. The solvent pump 12 further includes four check valves 36*a–d* that control the direction of flow of solvent through the solvent pump 12. More specifically, inlet valves 36*a–b* are disposed between the pumping chambers 18*a–b* and the inlet 26 to prevent solvent from being expelled from the pumping chambers 18*a–b* through the inlet 26, and outlet valves 36*c–d* are disposed between the pumping chambers 18*a–b* and the outlet 28 to prevent solvent from being drawn into the pumping chambers 18*a–b* through the outlet 28. The inlet valves 36*a–d* are illustrated as conventional ball valves, but may alternatively be flapper valves or other conventional one-way valves. The double diaphragm pump 12 includes an air control assembly 40 that controls operation of the pump 12. The air control assembly 40 is generally conventional and therefore will not be described in detail. Suffice it to say that the air control assembly 4 includes a spool valve 42 that supplies air to one air chamber 24*a* or 24*b* while exhausting air from the other air chamber 24*a* or 24*b*, and an air distribution rod 44 that actuates the spool valve 42 to alternate which air chamber 24*a–b* is supplied air and which is exhausted.

The cleaning system 10 includes an air injection system 16 that supplies pressurized air to each pumping chamber 18*a–b*. In the described embodiment, the air injection assembly 16 is timed to inject air into each pumping chamber 18*a–b* as that chamber expands. The air injection system 16 includes an injection assembly 50 and an actuation assembly 52. The injection assembly 50 is connected to a supply of pressurized air by supply line 56, to pumping chamber 18*a* by line 58*a* and to pumping chamber 18*b* by line 58*b*. A pressure regulator (not shown) is preferably installed along supply line 56 to permit control over the pressure of the air supplied to the pumping chambers 18*a–b*. In the described embodiment, the regulator is set to provide pressure ranging from approximately 60 to 80 psi. The injection assembly 50 includes a left injection valve 54*a* that selectively connects supply line 56 to line 58*a* to selectively supply pressurized air to pumping chamber 18*a*. Similarly, the injection assembly 50 includes a right injection valve 54*b* that selectively connects supply line 56 to line 58*b* to selectively supply pressurized air to pumping chamber 18*b*. A check valve or one-way valve 59*a–b* is preferably disposed along each of lines 58*a* and 58*b* to prevent pressurized fluid from being pumped up into the injection valves 54*a–b*. The injection valves 54*a–b* are preferably conventional air-actuated valves available from a wide variety of pneumatic controls suppliers, but may be replaced by other conventional on-off valves. In the preferred embodiment, the valve has a threshold actuation pressure of 40–60 pounds per square inch. This valve is specifically designed to preclude pass through of solvent, thereby preventing contamination of any upstream components, such as an air compressor and associated components.

The injection valves 54*a–b* are actuated by the actuation assembly 52. In the described embodiment, the actuation assembly 52 is connected to a supply of pressurized air by a supply line 60, to left injection valve 54*a* by line 62*a* and to right injection valve 54*b* by line 62*b*. A pressure regulator (not shown) is preferably installed along supply line 60 to permit control over the pressure of the air supplied to the pump 12 and injection valves 54*a–b*. In the described embodiment, the regulator is set to provide pressure ranging from approximately 60 to 80 psi. The actuation assembly 52 includes a left actuation valve 64*a* that selectively connects supply line 60 to line 62*a* and a right actuation valve 64*b* that selectively connects supply line 60 to line 62*b*. Right actuation valves 64*a* is connected to air chambers 24*a* by line 66*a*. Similarly, left actuation valves 64*b* is connected to air chambers 24*b* by line 66*b*. The actuation valves 64*a–b* are preferably conventional air-actuated valves, such as conventional injection and/or color change valves available from a variety of suppliers, including ITW Ransburg of Toledo, Ohio, but may be replaced by other conventional on-off valves. In the preferred embodiment, the valve has a threshold actuation pressure of 40–60 pounds per square inch. The valve is specifically designed to handle the high air pressure that may be generated within the air chambers.

Operation of the present invention will now be described in connection with FIGS. 2–7. FIG. 2 shows a paint supply system 300 generally including a module 302 that is connected to a paint circulation network 304. The module 302 includes a pump 306, a surge eliminator 308, a filter 310, a back pressure regulator 312 and a paint supply reservoir 314. The paint circulating network 304 preferably includes a network of paint heads or drops 316*a–c* that are connected to the module 302 by a plurality of paint lines 316. The cleaning system 10 is connected to the paint supply system 300 upstream from the module 202, for example, by connecting the outlet of the solvent pump 12 to the suction line 316 at paint supply reservoir 314 and the inlet of the solvent reservoir to the return line 318. The cleaning system 10 can alternatively be installed at other locations. In some applications, the cleaning system 10 can be installed to bypass the module 302, for example, by connecting the pump outlet 28 to the outgoing paint line and the inlet of the solvent reservoir to the return line 318.

Once installed, the solvent pump 12 is powered on to begin pumping solvent from a conventional solvent reservoir through the paint supply system 300. The pump 12 operates in a generally conventional manner by alternately supplying air to and venting air from the opposed air chambers 24*a–b*. The alternating supply and venting of air causes the diaphragm rod 30 to reciprocate within the housing 20, thereby causing the two pumping chambers 18*a–b* to alternately expand and contract. As each pumping chamber 18*a* or 18*b* expands, it draws fluid into the pump 12 through the inlet 26. As each pumping chamber 18*a* or 18*b* contracts, it expels the fluid out of the pump through the outlet 28. The timing of the pump 12 is controlled by the spool valve 42 and the distribution rod 44. The spool valve 42 is movable between two positions, which are referred to herein as the leftmost position and the rightmost position based on their location in the drawings. In the leftmost position, air is supplied to air chamber 24*a* and vented from air chamber 24*b*. In the rightmost position, air is supplied to air chamber 24*b* and vented from air chamber 24*a*. The position of the spool valve 42 is dictated by the position of the air distribution rod 44. When in its leftmost position, the air distribution rod 44 connects the left end of the spool valve 42 to pressurized air 80 and the right end to exhaust 82. This moves the spool valve 42 into its rightmost position. When in its rightmost position, the air distribution rod 44 connects the right end of the spool valve 42 to pressurized air 80 and the left end to exhaust 82. This moves the spool valve 42 into its leftmost position. As the diaphragm rod 30 reaches the end of its leftward stroke, it engages the right end of the air distribution rod 44 causing it to move from its rightmost position to its leftmost position (in turn moving the spool valve 42 from its leftmost position to its rightmost position). As the diaphragm rod 30 reaches the end of its rightward stroke it engages the left end of the distribution rod 44 moving it back into its rightmost position (in turn moving the spool valve 42 back into its leftmost position). The cycle of reciprocating motion repeats itself as the pump continues to run.

Figure 3:
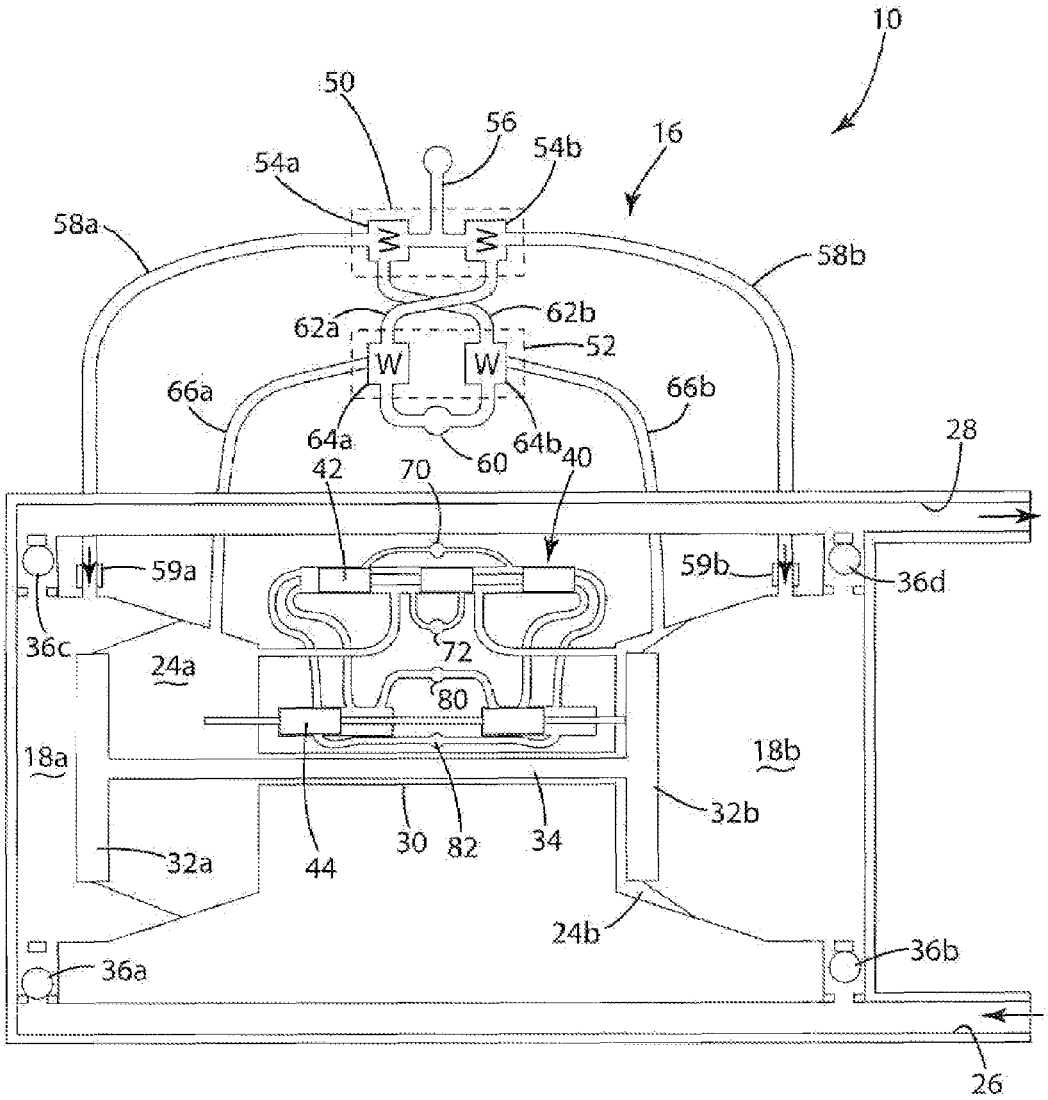
FIG. 3 is sectional view showing the solvent pump and air injection system in a first position.
Figure 4:
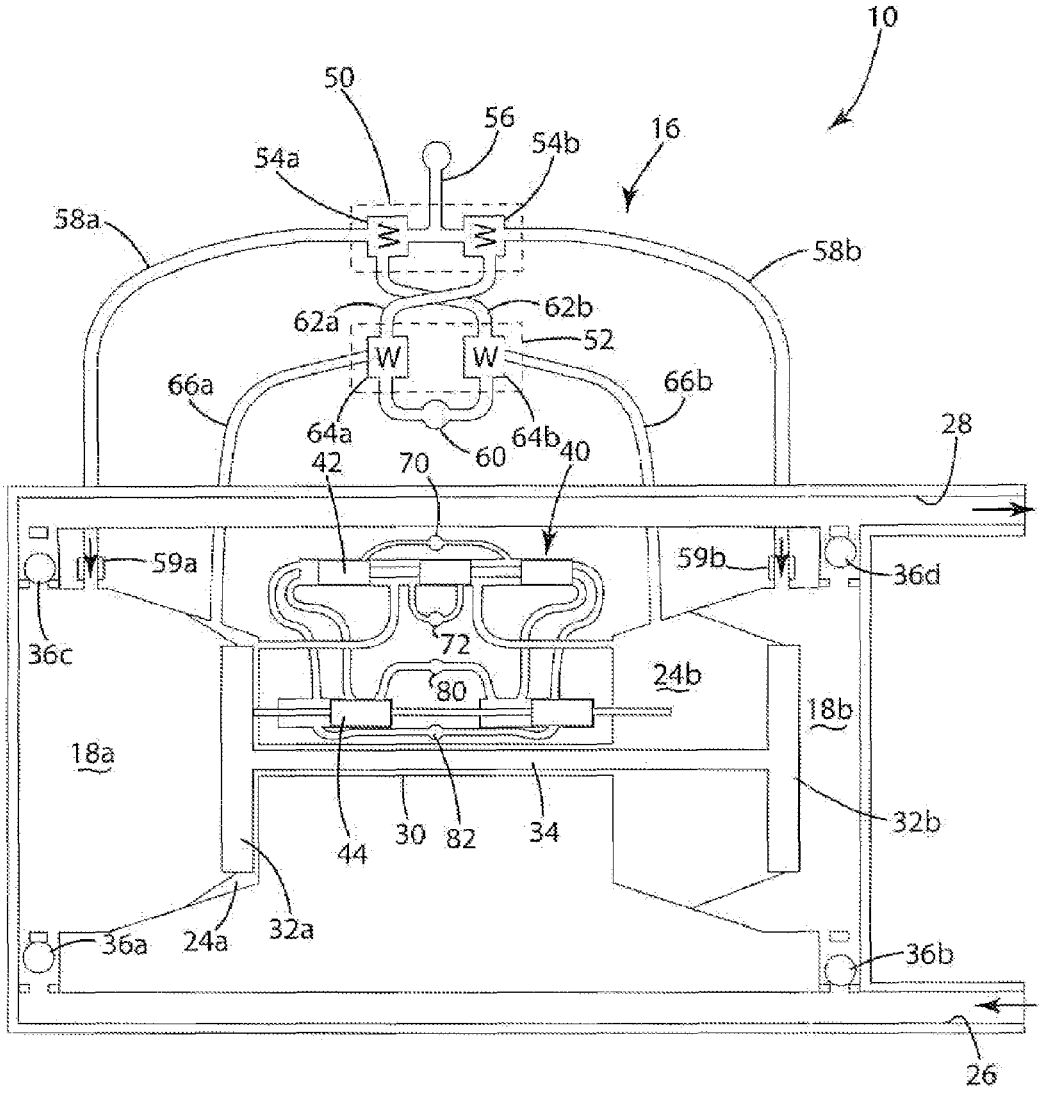
FIG. 4 is sectional view showing the solvent pump and air injection system in a second position.
Figure 5:
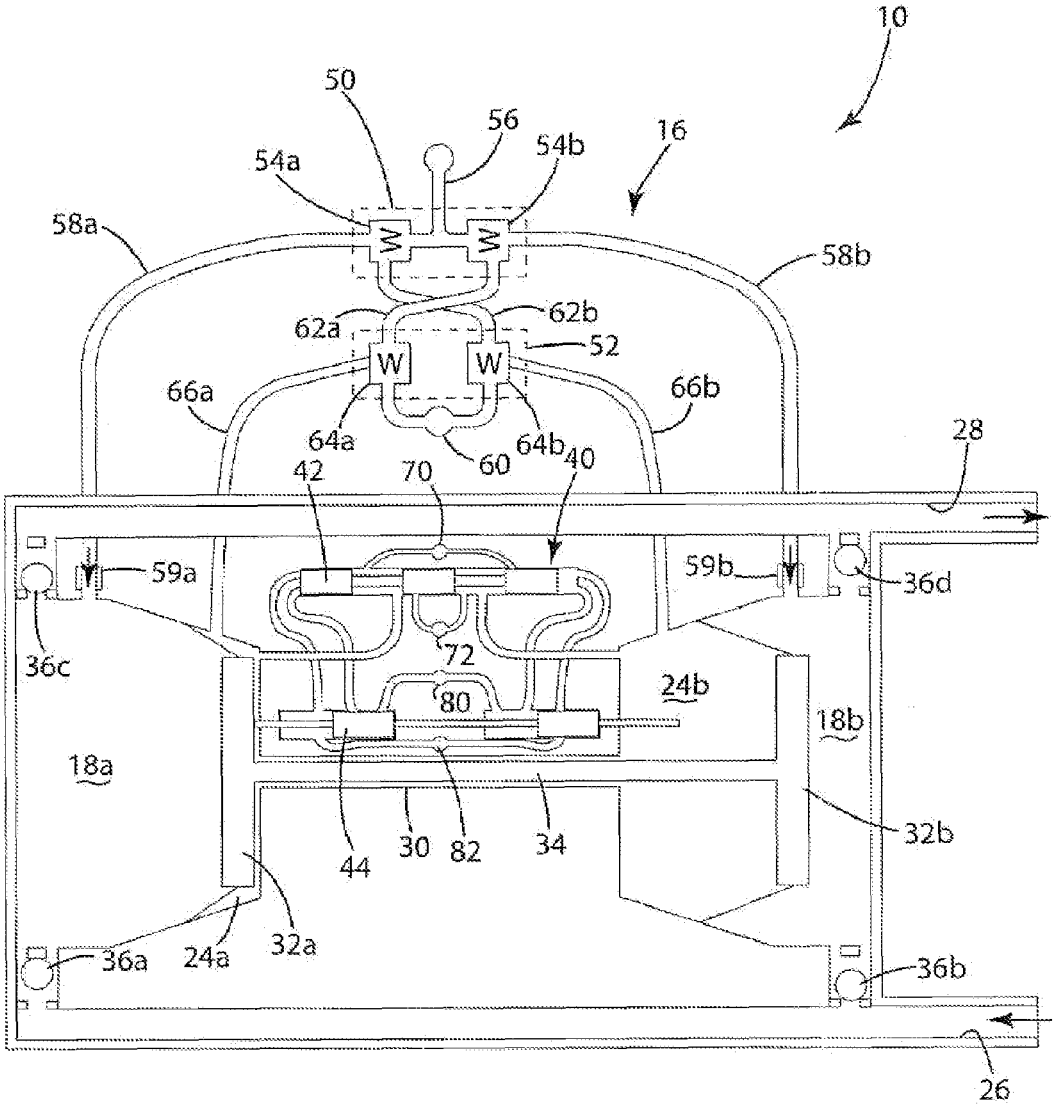
FIG. 5 is sectional view showing the solvent pump and air injection system in a third position.
Figure 6:
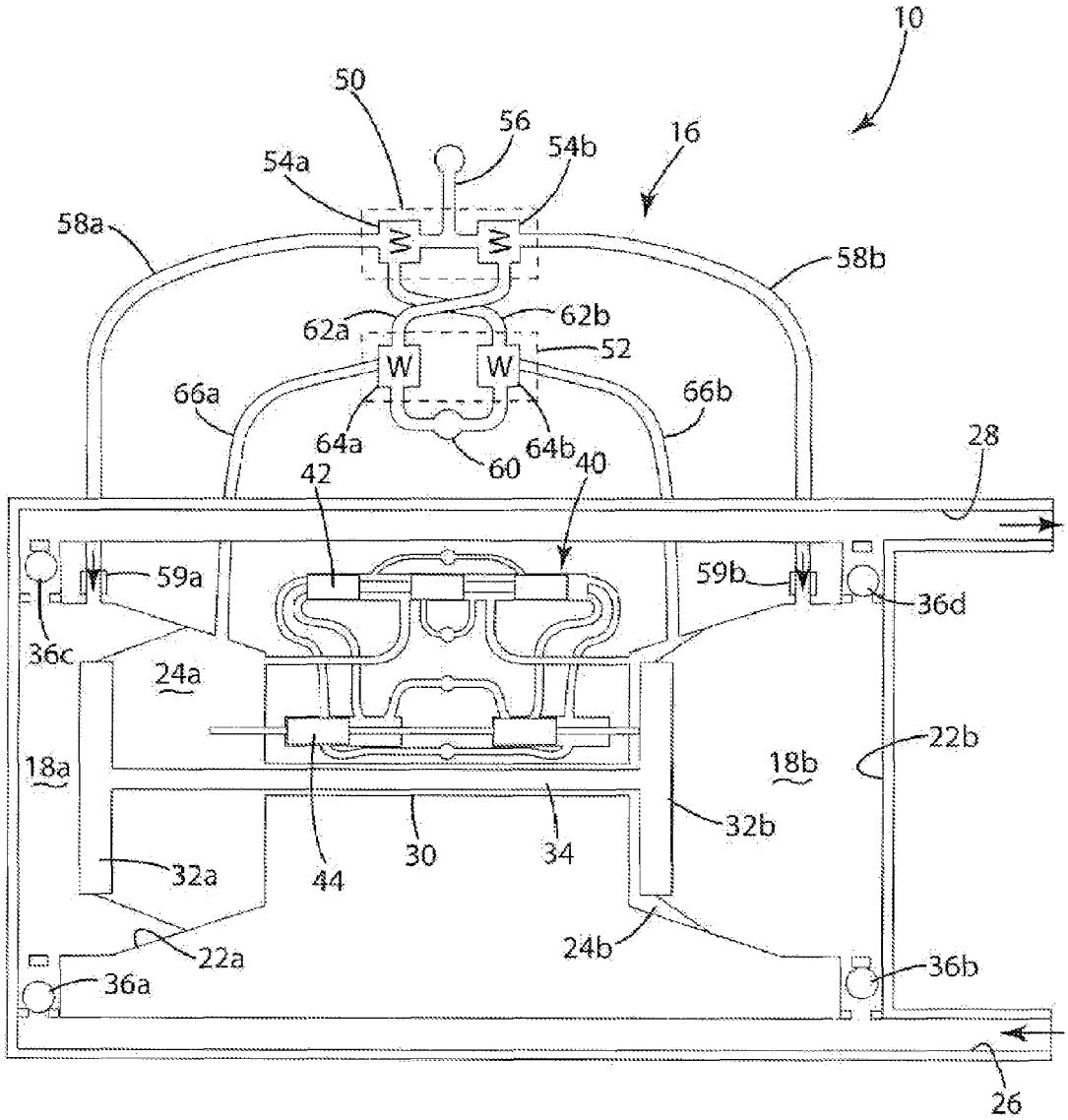
FIG. 6 is sectional view showing the solvent pump and air injection system in a fourth position.

Operation of the cleaning system 10 will now be described in more detail beginning with the diaphragm rod 30 in the leftmost position and the spool valve 42 in the rightmost position (See FIG. 3). In this position, the spool valve 42 connects air chamber 24*b* to the supply of pressurized air 70 and air chamber 24*a* to the air exhaust 72. As air is supplied to the air chamber 24*b*, the pressure within the air chamber 24*b* increases. Because they are connected, this also increases the pressure in line 66*b*. Once the pressure in air chamber 24*b* and line 66*b* reaches the threshold of right actuation valve 64*b*, the right actuation valve 64*b* is opened, thereby connecting the supply line 60 to left injection valve 54*a*. The pressurized air in supply line 60 opens left injection valve 54*a*, thereby connecting supply line 56 to pumping chamber 18*a* through line 58*a*. This causes pressurized air to be injected directly into the pumping chamber 18*a*. In the described embodiment, the air is injected into the pumping chamber 18*a* during the loading stage of the pumping chamber 18*a* (i.e. as it expands to create a partial vacuum that draws solvent into the pumping chamber). The supply of air to the pumping chamber 18*a* continues until the diaphragm rod 30 has completed its stroke (See FIG. 4). As it completes its stroke, the diaphragm rod 30 actuates the air distribution rod 44 moving it into its rightmost position. This connects the right end of the spool valve 42 to pressurized air 80 and the left end of the spool valve 42 to exhaust 82. This moves the spool valve 42 into the leftmost position (See FIG. 5). In this position, the spool valve 42 connects air chamber 24*b* to the supply of pressurized air and air chamber 24*a* to the air exhaust. This permits air chamber 24*a* to vent decreasing its internal pressure. When the pressure in the air chamber 24*b* drops below the threshold value of the right actuation valve 64*b*, the right actuation valve 64*b* closes. This stops the supply of pressurized air to the left injection valve 54*a*, thereby causing the left injection valve 54*a* to close stopping the supply of air to the pumping chamber 18*a*. At the same time, the new position of the spool valve 42 routes pressurized air to air chamber 24*a*. This causes the pressure in air chamber 24*a* and line 66*a* to increase. Once this pressure reaches the threshold pressure of left actuation valve 64*a*, the left actuation valve 64*a* opens and supply line 60 is connected to line 62*a*, routing pressurized air to the right injection valve 54*b*. This opens right injection valve 54*b* and connects supply line 56 to the right pumping chamber 18*b*. As a result, pressurized air is injected directly into the pumping chamber 18*b* as that chamber undergoes expansion. As it completes its stroke, the diaphragm rod 40 actuates the air distribution rod 44 moving it into its leftmost position (See FIG. 6). This ultimately moves the spool valve 42 back into its rightmost position (See FIG. 3). The process continues as the diaphragm rod 30 reciprocates within the housing 20.

If desired, the paint supply system 300 can by pigged prior to the solvent flush using conventional techniques and apparatus. For example, the module 302 can be disconnected from the paint circulating network 304 and a pig can be forced through the paint lines 316 in a conventional manner. This is not, however, a necessary step in the practice of the present invention.

Alternative Embodiments

The above-described embodiment is intended to provide an example of one implementation of the present invention, and is not intended to place any limitation on the scope of the invention. The present invention is well suited for use with a variety of pump types. It includes a number of optional features including, without limitation, a dedicated solvent pump and separate injection and actuation assemblies.

Figure 7:
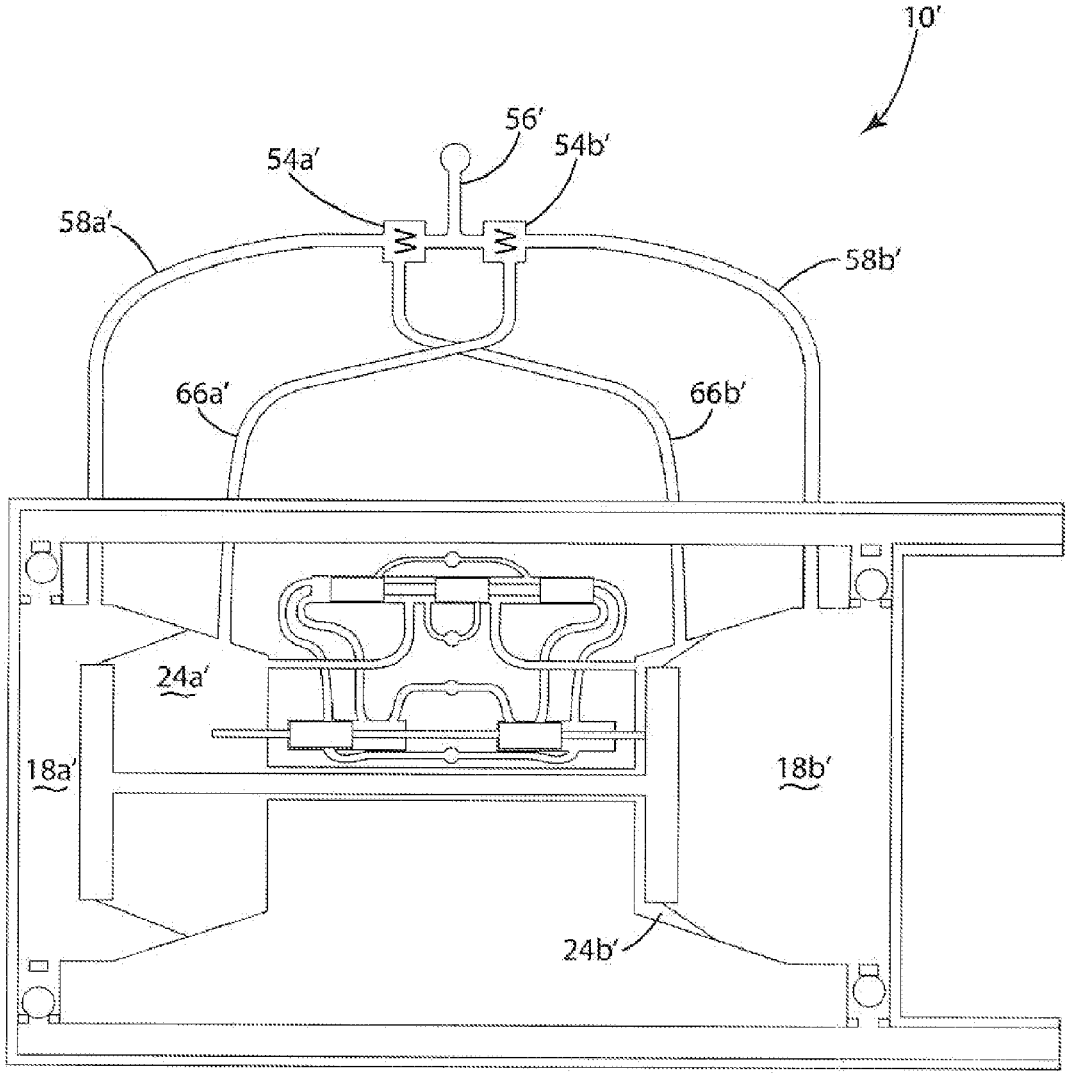
FIG. 7 is sectional view showing an alternative solvent pump and air injection system.

In a first alternative cleaning system 10', the actuation assembly 52 is eliminated and the injection valves 54*a–b*' are operated directly by pressure from the air chambers 24*a–b*'. As shown in FIG. 7, the injection valves 54*a*' and 54*b*' are connected directly to the air chambers 24*b*' and 24*a*', respectively, by lines 66*a*' and 66*b*'. When the pressure in an air chamber 24*a*' or 24*b*' exceeds the threshold pressure of the corresponding injection valve 54*b*' or 54*a*', the injection valve 54*b*' or 54*a*' opens permitting pressurized air to flow from supply line 56' to the corresponding pumping chamber 18*b*' or 18*a*' via lines 58*a*' and 58*b*'.

In a second alternative embodiment, the timing of the air injection system is based on pressure within the air inlet or air exhaust from each air chamber. Although not illustrated, this embodiment is generally identical to the first embodiment described above, except that the actuation valves are connected to the exhaust manifolds or inlet manifolds for the air chambers. As with the first alternative embodiment discussed above, the actuation valves can be eliminated and the injection valves can be actuated directly by the pressure in the exhaust manifolds or inlet manifolds (not shown). In some applications, the exhaust may not develop sufficient back pressure to operate the mechanical actuation and/or injection valves. In such applications (or in application where it is otherwise desirable), the mechanical valves may be replaced by conventional electromechanical valves. For example, the mechanical actuation valves can be replaced by electromechanical valves and pressure sensors may be installed in the air exhausts (or air inlets) to provide a signal when each exhaust (or inlet) is under pressure. An electronic control is provided to monitor the sensors and actuate the appropriate electromechanical valve in response to their signals. Another alternative is to replace the mechanical injection valves with electromechanical valves so that an electronic control can directly open and close the injection valves in response to pressure in the inlet or exhaust, as desired. This would eliminate the actuation valves and related components.

Figure 8:
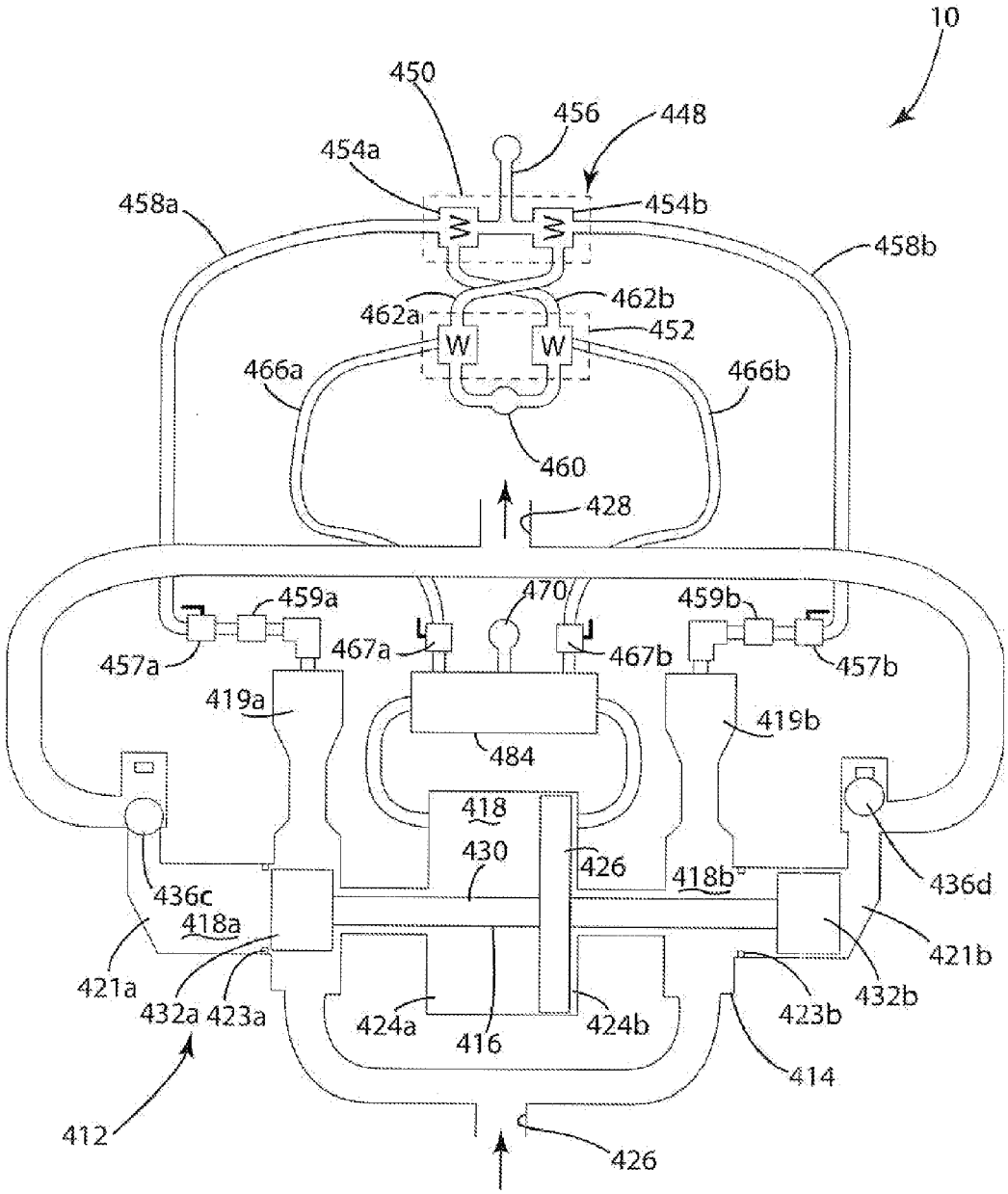
FIG. 8 is a sectional view of an alternative embodiment showing an air injection system-incorporated into a paint supply pump.

In a third alternative embodiment, the air injection system can be incorporated directly into the paint supply pump, rather than including a separate, dedicated solvent pump. This has the advantage of eliminating the need to install and remove the cleaning system 12 from the paint supply system 300 each time that a cleaning is performed. This embodiment will be described in connection with a conventional Graco Glutton positive displacement pump. This particular pump is intended to be exemplary and not a limit on the types of pumps that are suitable for use with the present invention. Binks Polycraft and Excel pumps are similar in operation to the Graco Glutton pump and suited for incorporation of the present invention essentially as described in connection with this particular embodiment. The present invention can also be readily incorporated into other pumps. Referring now to the schematic illustration of FIG. 8, the pump 412 includes a reciprocating piston assembly 416 seated within a housing 414. The piston assembly 416 generally includes a piston rod 430, a central piston 426 mounted in the center of the piston rod 430 and a pair of pistons 432*a–b* mounted to opposite ends of the piston rod 430. The housing 414 defines a central void 418 that receives and is divided into a pair of air chambers 424*a–b* by the central piston 426. The housing 414 also defines a pair of pumping chamber 418*a–b* that receive the piston 432*a–b*, respectively. Although not specifically illustrated, the pump 412 includes an air control assembly that creates reciprocating motion of the piston rod 416 within the housing 414 using energy provided by a supply of pressurized air 470. The air control assembly (not shown) operates the pump 412 in a generally conventional manner and therefore will not be described in detail. Suffice it to say, that as the rod 430 reciprocates, the pistons 432*a–b* alternately retract and extend. As a piston 432*a–b* retracts, it expands the effective area of the corresponding outlet portion 421*a–b*, thereby creating a partial vacuum that draws a volume of fluid through the inlet 426 into the corresponding pumping chamber 418*a–b*. As a piston 432*a–b* extends, it contracts the effective area of the corresponding outlet portion 421*a–b*, thereby forcing a volume of fluid from that outlet portion 421*a–b* to the outlet 428.

As with the embodiments described above, this embodiment includes an air injection system 448 that injects air into the pumping chambers 418*a–b* of the pump 412. Except as described, the air injection system 448 of this embodiment is essentially identical to the air injection system 16 of the first described embodiment. In this embodiment, the air injection system 448 generally includes an injection assembly 450 that injects air into the pumping chambers 418*a–b* and an actuation assembly 452 that controls the timing of the injection assembly 450. The injection valves 454*a–b* are connected to a supply of pressurized air 456 and to the pumping chambers 418*a–b* by lines 458*a–b*, respectively, for example, at the accumulators 419*a–b*. The lines 458*a–b* can alternatively be mounted at other locations within the pumping chambers 418*a–b*, such as along outlet portion 21*a–b* between the piston seal 423*a–b* and the outlet valve 436*c–d*. Check valves 459*a–b* (or other one-way valves) are preferably installed along each line 458*a–b*, respectively, to prevent flow of pressurized fluid into the injection valves 454*a–b*. In addition, ball valves 457*a–b* (or other on/off valves) are preferably installed along each line 458*a–b*, respectively, to permit the lines 458*a–b* to be positively shut-off when the pump 412 is not in the cleaning mode. The actuation valves 464*a–b* are connected to a supply of pressurized air 460 and to the inlet manifolds 484 of the air chambers 424*a–b* by lines 466*a–b*, respectively. Ball valves 467*a–b* (or other on/off valves) are preferably installed along each line 466*a–b*, respectively, to permit the lines 466*a–b* to be positively shut-off when the pump 412 is not in the cleaning mode. This maintains the actuation valves 464*a–b* in closed position, precluding operation of the cleaning system. The injection valves 454*a–b* and actuation valves 464*a–b* operate in essentially the same way to provide pressurized air to each pumping chamber 418*a–b* as that chamber 418*a–b* undergoes expansion. Although the actuation valves 464*a–b* are operated by pressure within inlet manifolds 484, the timing of the air injection valves 454*a–b*, and hence the air injection, is essentially the same as the first embodiment described above. If desired, the actuation valves 454*a–b* can be alternatively connected to opposite pumping chambers 418*a–b* rather than the inlet manifolds 484. To perform a solvent flush with this embodiment, the pump 412 is stopped and the paint reservoir is replaced with a solvent reservoir. Additionally, the ball valves 457*a–b* and 469*a–b* on lines 458*a–b* and 466*a–b* are opened to permit operation of the actuation valves 464*a–b* and injection valves 454*a–b*. The pump 412 is then restarted so that it circulates solvent through the paint supply system. If desired, the system can be pigged using conventional techniques and apparatus prior to running a solvent flush.

The various embodiments described above include mechanical systems for controlling the timing of the air injection system (i.e. the timing of the injection of air into the pumping chambers). In other embodiments, the mechanical system can be replaced by a computer or electronic control system that opens and closes the injection valves in accordance with the appropriate timing scheme. In such applications, the injection valves may be replaced by conventional electromechanical valves capable of opening and closing in response to control signals. The computer or electronic control system may obtain timing information from the pump, for example, by sensing the pressure within the inlet manifolds, outlet manifolds or pumping chambers. Alternatively, the timing information may be obtained by switches or sensors that are actuated in response to movement of the diaphragm rod, air distribution rod or spool valve.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A cleaning system for a paint supply system comprising:

a pump for circulating solvent through the internal components of the paint supply system, said pump including at least one expanding and contracting pumping chamber; and an air injection system for injecting pressurized air into said pump, said air injection system injecting air directly into said pumping chamber of said pump, whereby said air is entrained within said solvent;

a control means for controlling said air injection system to inject air into said pumping chamber as said pumping chamber is expanding;

wherein said control means includes an injection valve operatively connected between said pumping chamber and a supply of pressurized air, said valve being operable to connect said supply of pressurized air to said pumping chamber;

wherein said control means further includes an actuation valve operatively connected between said injection valve and a supply of pressurized air, said valve being operable to connect said supply of pressurized air to said injection valve, said injection valve being configured to open in response to said pressurized air; and wherein said pump is a pneumatically actuated pump, said pump including at least one air chamber for operating said pump, said control means including a means for opening said actuation valve in response to pressure within said air chamber.

2. The system of claim 1 wherein said pump is a double-action pneumatically actuated pump having first and second pumping chambers, said control means including first and second injection valves, said first injection valve being connected between a supply of pressurized air and said first air chamber, said second injection valve being connected between a supply of pressurized air and said second air chamber.

3. The system of claim 2 wherein said pump includes first and second air chambers, said control means including first and second actuation valves, said first actuation valve being connected between a supply of pressurized air and said first injection valve, said second actuation valve being connected between a supply of pressurized air and said second injection valve.

4. The system of claim 3 wherein said first actuation valve is operable in response to pressure within said second air chamber; and said second actuation valve is operable in response to pressure in said first air chamber.

5. A cleaning system for flushing a coating supply system with a solvent comprising:

a solvent reservoir containing a volume of solvent;

a pump for circulating said solvent through at least a portion of the internal components of the coating supply system, said pump including at least one pumping chamber that expands and contracts during operation of said pump;

an air injection system connected to said pump, said injection system injecting air into said pumping chamber of said pump whereby said air is entrained within said solvent and circulates through said coating supply system with said solvent;

wherein said air injection system includes a control means for controlling operation of said air injection system, said control means including an injection valve connected between said pump and a supply of pressurized air, said control means selectively opening said injection valve to supply pressurized air to said pump;

wherein said injection valve is connected between a supply of pressurized air and said pumping chamber, whereby air is injected directly into said pumping chamber when said injection valve is open;

wherein said control means includes a timing means for opening said injection valve when said pumping chamber is expanding;

wherein said pump includes at least one of an air inlet, an air outlet and an air chamber; and said timing means includes means for opening said injection valve in response to pressure within at least one of said air inlet, said air outlet and said air chamber.

6. The system of claim 5 wherein said timing means includes an actuation valve that opens and closes in response to pressure within at least one of said air inlet, said air outlet and said air chamber.

7. The system of claim 6 wherein said actuation valve is connected between said injection valve and a supply of pressurized air to supply pressurized air to said injection valve when said actuation valve is in an open position and thereby open said injection valve.

8. The system of claim 7 wherein said actuation valve is a mechanical valve that opens in direct response to pressure within at least one of said air inlet, said air outlet and said air chamber.

9. The system of claim 7 wherein said actuation valve is an electromechanical valve that opens in response to signals from a pressure sensor within at least one of said air inlet, said air outlet and said air chamber.

10. The system of claim 7 wherein said injection valve is a mechanical valve that opens in response to pressurized air received through the actuation valve.

11. The system of claim 5 wherein said injection valve is an electromechanical valve that opens in response to signals from a pressure sensor within at least one of said air inlet, said air outlet and said air chamber.

12. A method for flushing a coating supply system with a solvent, comprising the steps of:

pumping a solvent through internal components of the coating supply system via a pump having an expanding and contracting pumping chamber; and injecting air directly into the pumping chamber of the pump as the pump is pumping solvent through the coating supply system, wherein said injecting step is further defined as pumping air into the pump in response to a pressure sensed within at least one of the air inlet, air outlet or air chamber of the pump.

13. The method of claim 12 wherein said injecting step is further defined as pumping air directly into a pumping chamber in the pump.

14. A method for flushing a coating supply system with a solvent, comprising the steps of:

pumping a solvent through internal components of the coating supply system via a pump having an expanding and contracting pumping chamber; and injecting air directly into the pumping chamber of the pump as the pump is pumping solvent through the coating supply system, wherein said injecting step includes the steps of:

sensing a pressure within at least one of the air inlet, air outlet or air chamber of the pump; and connecting a supply of pressurized air to the pump in response to the sensed pressure.

15. The method of claim 14 further including the step of connecting an injection valve between a supply of pressurized air and the pumping chamber; and wherein said sensing step further includes the steps of:

connecting a pressure-actuated actuation valve between a supply of pressurized air and the injection valve, the actuation valve further being operably connected to an air chamber in the pump, whereby the actuation valve is capable of opening and closing in response to pressure in the air chamber;

operating the actuation valve in response to pressure in the air chamber, whereby the injection valve is operated in response to pressure in the air chamber.

16. The method of claim 14 wherein the pump includes first and second injection valves and first and second pumping chambers, said injecting step including the steps of alternately opening and closing the first and second injection valves to alternately supply pressurized air to the first and second pumping chambers.

17. The method of claim 16 wherein the pump includes first and second air chambers; and further including the steps of:

connecting a first pressure-actuated actuation valve between a supply of pressurized air and the first injection valve, the actuation valve further being operably connected to the second air chamber in the pump;

connecting a second pressure-actuated actuation valve between a supply of pressurized air and the second injection valve, the second actuation valve further being operably connected to the first air chamber in the pump;

said injecting step including the steps of:

operating the first actuation valve in response to pressure in the second air chamber, whereby the first injection valve injects air into the first pumping chamber in response to pressure in the second air chamber; and operating the second actuation valve in response to pressure in the first air chamber, whereby the second injection valve injects air into the second pumping chamber in response to pressure in the first air chamber.

* * * * *